United States Patent [19]

Aujla et al.

[11] 4,310,212

[45] Jan. 12, 1982

[54] RETAINER MEMBER WITH DUAL ACTION CANTILEVER BEAMS

[75] Inventors: Sharanjit S. Aujla, Kanata; John D. Lee, Manotick, both of Canada

[73] Assignee: Northern Telecom Limited, Montreal, Canada

[21] Appl. No.: 166,619

[22] Filed: Jul. 7, 1980

[51] Int. Cl.[3] ..... H01R 11/20

[52] U.S. Cl. ..... 339/97 R

[58] Field of Search ..... 339/97, 98, 99, 99 R

[56] References Cited

U.S. PATENT DOCUMENTS

| | | | |
|---|---|---|---|
| 3,444,506 | 5/1969 | Wedekind | 339/99 R |
| 3,820,055 | 6/1974 | Huffnagle | 339/97 R X |
| 4,062,614 | 12/1977 | Gressitt | 339/97 R |
| 4,066,316 | 1/1978 | Rollings | 339/91 R |
| 4,169,646 | 10/1979 | Stape | 339/99 R |

*Primary Examiner*—Joseph H. McGlynn
*Assistant Examiner*—John S. Brown
*Attorney, Agent, or Firm*—Sidney T. Jelly

[57] ABSTRACT

A retaining member for retaining cylindrical members, such as rods and wires, has a base and a pair of cantilevered dual action beams extending from the base, the beams having parallel opposed spaced apart inner edges, each beam having an upper and a lower portion, the lower portion having an upwardly and inwardly inclined outer edge and the upper part having an upwardly and outwardly inclined outer edge, the conjunction of the two portions forming a neck, and an entrance portion defined by a downwardly and inwardly inclined upper edge on each beam, the upper edges merging with the inner edges by a radius. Insertion of a cylindrical member deforms the upper portions to a large extent the portions bending about the necks. The lower portions are deformed to a lesser extent and have substantially uniform stress distribution. The members are particularly useful as contacts for insulation conductors, the insulation being crushed and during passage between the upper portions of the beams and removed on passage past the necks. The conductor is deformed while being pushed down between the upper portions and past the necks, to give a highly effective connection.

9 Claims, 8 Drawing Figures

RETAINER MEMBER WITH DUAL ACTION CANTILEVER BEAMS

This invention relates to retaining members having dual action cantilever beams, that is with two spaced beams between which a further member is pushed to be retained therein. Particularly, though not exclusively, the invention is applicable to contacts for electrical conductors, and more particularly to insulation displacing contacts for insulated conductors.

Conductor contacts, and particularly insulation displacing contacts are well known, comprising generally, two spaced legs or beams, between which the conductor is pushed. Where the conductor is insulated, the insulation may be removed or displaced by crushing, cutting or slicing. In crushing the insulation is squeezed between conductor and terminal and pushed off the conductor. A typical example of such a terminal is described in U.S. Pat. No. 3,112,147. In cutting, the insulated conductor is pushed down between two cutting edges which extend in a direction normal to the axis of the conductor. In such terminals the cutting edges cut through the insulation, which may then be deformed sideways. U.S. Pat. No. 3,027,536 describes one form of such a terminal. In slicing, as described in U.S. Pat. No. 3,521,221, two parallel cuts are made through the insulation, in the direction parallel to the axis of the conductor, and a short length of insulation is removed from the conductor.

The previous forms of terminal generally have legs or beams which either have substantially parallel sides or taper in one direction, acting as cantilevers. As a conductor is pushed down between the beams or legs they are stressed, but the stress is not uniformly distributed, the stresses being concentrated at the roots of the beams, both during wire insertion and when the wire is at rest in the terminal. The terminals have poor elastic compliance and a high wire insertion force, with poor specific volume efficiency. Also, for insulated conductors, such terminals are often effective for only one type, or a limited number of types of insulation.

The present invention provides a retaining member which has improved qualities and a high degree of stress uniformity. Basically, a retaining member comprises two beams or legs having opposed, spaced apart, substantially parallel inner edges, the lower portion of each leg tapered upward and inward and the upper portion tapered upward and outward at the outer edge, and an entrance portion defined by downwardly and inwardly inclined upper edges of the beams, the upper edges merging into the opposed inner edges by a radius. Particularly, a contact embodying the present invention provides a contact which will accept a range of conductor sizes, and will accept conductors having many different types of insulation, with efficient stripping properties, improved connection quality and with the high degree of stress uniformity.

Initial deformation of the legs occurs at the top portions when a conductor is pushed in, the insulation being removed, the bare conductor then passing down between the lower portions of the beams, being deformed thereby.

The invention will be readily understood by the following description of certain embodiments of electrical contacts, by way of example, in conjunction with the accompanying drawings, in which.

Figure 1:
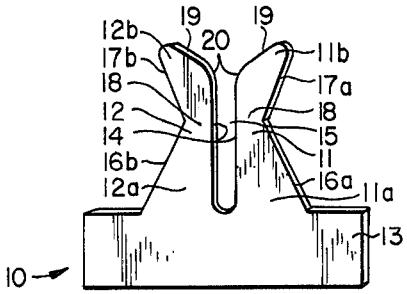
FIG. 1 is a perspective view of a contact in accordance with the invention.

As illustrated in FIG. 1, a contact, indicated generally at 10, has two beams 11 and 12 extending upwardly from a base 13. The beams 11 and 12 have opposed inner edges 14 which are parallel and spaced apart a predetermined distance according to the wire size or sizes to be accepted, to define a slot 15. The outer edge of each beam is in two parts **16*a* and 16*b* and 17*a* and 17*b* respectively, the lower parts 16*a* and 16*b* inclined upwardly and inwardly and the upper parts 17*a* and 17*b* inclined upwardly and outwardly, the two parts of each surface conjoined at a neck position 18. Each beam has an upper or top edge 19 inclined upwardly and outwardly, from the slot 15, each top edge 19 is joined to the related inner edge 14 by a radius 20**.

Thus each beam has a lower portion **11*a* and 12*a* and upper portions 11*b* and 12*b* respectively, the neck 18 defining the junction of the portions. It is preferred that the necks 18 are below the junction of the inner edges 14 with the radii 20**.

Figure 2:
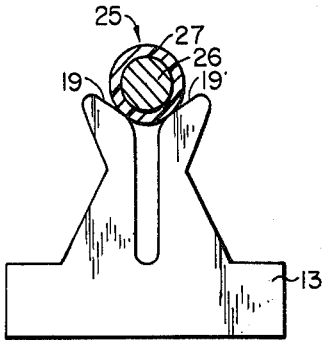
FIGS. 2, 3 and 4 illustrate successive steps in inserting a conductor into a contact as in FIG. 1.
Figure 3:
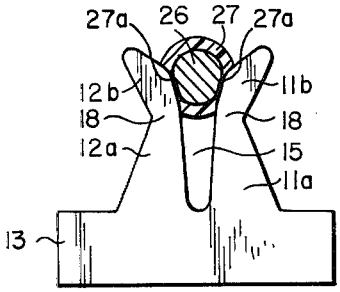
Figure 4:
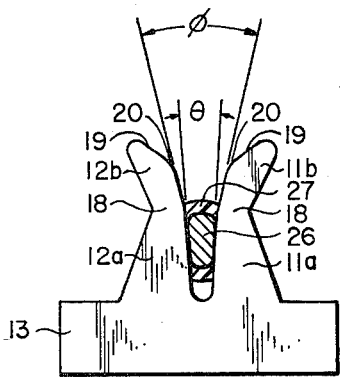

FIGS. 2, 3 and 4 illustrate certain steps in inserting a conductor into a terminal. In FIG. 2 an insulated conductor 25, having a conducting core 26 and an insulating layer 27 is resting on the top edges 19. On initial pushing of the conductor into the terminal past the radii 20, two events occur. The top parts **11*b* and 12*b* of the beams 11 and 12 deflect outwards, in effect pivotting at the necks 18**.

At the same time the insulation is crushed and partially pushed off of the conductor core 26. This condition is illustrated in FIG. 3, there having been some initial deformation of the core 26 and a thin layer of insulation 27, seen at **27*a*, stil on the core. Further pushing in of the conductor, past the neck position 18, removes the insulation and finishes the deformation of the core, the conductor moving down into the slot 15 between parts 11*a* and 12*a***.

The upper portions **11*b* and 12*b* are extensively and plastically deflected or deformed past the elastic limit of the material, particularly at the neck 18, during the action of stripping the insulation, while the plastic deformation of the lower portions 11*a* and 12*a* is minimized. The upper portions remain deformed, as illustrated in FIG. 4, the angle between the top portion of the opposed sides 14** being $\phi$ and the angle between the bottom portions of the opposed sides being $\theta$.

With the present invention, the relatively high stresses encountered during insulation stripping at the entry point are largely distributed in the upper portions **11*b* and 12*b* with the lower portions 11*a* and 12*a*** being uniformly stressed, to a lower extent than the upper parts. With the tapering of the lower portions, the beams have improved specific volume efficiency and an increased elastic compliance. It is the lower stressed lower portions of the beams which provide the desired wire rest point properties. The contact provides lower insertion forces compared to conventional designs, while at the same time providing effective insulation removal and adequate contact forces to ensure a gas-tight connection and satisfactory conductor retention.

As compared with previous contacts, the present contact has independently deflecting cantilever type dual-taper beams, with dual action, as opposed to the more uniform or single taper beams previously used.

The dual action beams provide efficient insulation stripping at low wire insertion forces without sacrificing wire rest point compliance, whereas high insertion forces occur with previous designs during insulation stripping with similar or lower rest point compliance.

The present design permits the use of optimum tapered beams with more uniformly distributed stresses. This gives increased elastic compliance compared to previous terminals when the face end portion of each beam normally works at a lower stress than that at the base of a beam, resulting in a considerably greater permanent set in the beams.

The contacts are rugged and cheaply produced by stamping. With improved stress distribution, thinner material and a smaller overall size can be obtained.

Figure 5:
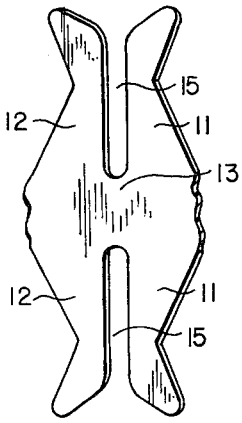
FIGS. 5, 6 and 7 illustrate alternate forms of contact using the basic design as in FIG. 1.
Figure 6:
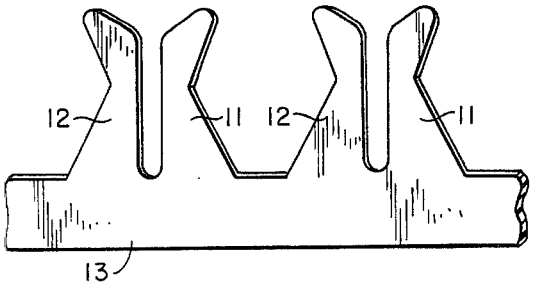
Figure 7:
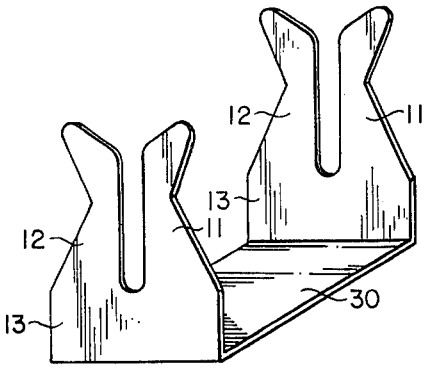

FIGS. 5, 6 and 7, illustrate three variations or alternate arrangements of the contact as in FIG. 1, and FIGS. 2 to 4. While in FIG. 1, a single contact is illustrated, multiple forms can also be provided. FIG. 5 illustrates a "back-to-back" arrangement with beams 11 and 12 extending from both sides of a common base 13. FIG. 6 illustrates a strip arrangement, in which two or more contacts are formed from a long strip having a long base 13. FIG. 7 illustrates a double contact in which the bases 13 are common with an interconnecting web 30.

Figure 8:
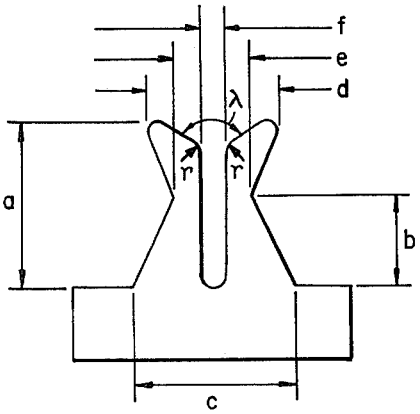
FIG. 8 illustrates a contact as in FIG. 1, with the various important dimensions indicated.

As previously stated, a range of conductor sizes can be accommodated by one particular size of contact, if desired, although contacts can be designed specifically for each conductor size. In FIG. 8 is illustrated a contact, as in FIG. 1 and in FIGS. 2, 3 and 4, for acceptance of 22, 24 and 26 AWG telephone wire conductors. The various dimensions indicated, and listed below, are for each conductor but are approximate and can be varied. Thus the angle λ can vary as can the radii r but the particular dimensions and values given are particularly suitable for telephone conductors, having copper conductors, of the gauges given. All the generally used insulating materials can be stripped, e.g. paper pulp, plastic, foam, foam skin, etc.

The particular dimensions and values for FIG. 8 are as follows:

$a \simeq 0.1$ inches
$b \simeq 0.07''$
$c \simeq 0.09''$
$d \simeq 0.07''$
$e \simeq 0.05''$
$f \simeq 0.01''$
$r \simeq 0.02''$
$\lambda \simeq 120°$ As stated, it is preferred that the position of the neck 18 be below the junction of the radius 20 and the inner edges 14, and that the rest point of the conductor 26 is below the neck 18. The angle λ and radius r affect the initial insertion force and the force applied to the insulation. The slot width f, radius r and dimension (a-b), determine both the amount of deformation of the conductor core and the bending or spreading of the legs 11 and 12, which both also depend upon the conductor size. A typical material is phosphor bronze, of about 0.012" thickness.

Cutting or other metal is minimized by the dual action beam and there is minimal reduction in conductor strength after insulation into the contact. This is true even when very thin material is used for the contact.

While specifically described for use with insulated conductors, the contact can be used with bare conductors. There may be reduced deformation of the beams, without the insulation, but the same basic situation occurs with deformation of the conductor occurring prior to entry into the slot 15. Similar structures can be used to retain small diameter rods or "wires" of other materials than metal, and it is possible to make the retaining member of non-metallic material, depending upon use.

What is claimed is:

1. A retaining member with dual action cantilever beams, comprising:

a base having an upper surface;

a pair of cantilever beams extending from the upper surface of the base and having opposed, spaced apart, substantially parallel inner edges, each beam having upper and lower portions and an entrance portion said edges defining a parallel sided open-ended slot extending from the upper surface;

each lower portion defined by an outer edge tapered upward and inward from said upper surface of said base and by a lower part of said inner edge;

each upper portion defined by an outer edge tapered upward and outward from said lower portion and by an upper part of said inner edge;

a neck in each beam defined by the conjunction of said outer edges of said upper and lower portions and by said inner edge;

said entrance portion defined by upper edges of said beams, said upper edges inclined upwardly and outwardly from said inner edges, said upper edges and said inner edges joined by radii;

said necks defining pivotting position, said upper portions permanently deforming relative to said lower portions at said necks when a cylindrical member is initially inserted and said lower portions elastically deforming on further insertion of said cylindrical member.

2. A retainer as claimed in claim 1, for use as a contact for reception of an electrical conductor, the retainer being of electrically conductive material.

3. A retainer as claimed in claim 1, said upper portions adapted to permanently deform from said necks, to a greater extent than said lower portions, on insertion of a conductor.

4. A retainer as claimed in claim 1, said upper portions adapted to crush any insulation on said conductor and initiate deformation of said conductor, said insulation removed from said conductor and said conductor deformed at least to a major part on passage of said conductor past said necks.

5. A retainer as claimed in claim 1, said lower portions of said beams tapered to provide substantially uniform stress distribution on insertion of a conductor.

6. A retainer as claimed in claim 3, said upper portions deformed such that said inner edge at said upper portion is inclined to said inner edge at said lower portion for each beam after insertion of a conductor.

7. A method of inserting a cylindrical member into a retainer, said retainer comprising a base and a pair of dual action cantilever beams extending from said base, the beams having opposed, spaced apart, substantially parallel inner edges and lower and upper portions, the lower portions in each beam defined by an upward and inwardly inclined outer edge and the upper portion by an upward and outwardly inclined outer edge, and an

United States Patent [19]

Fetterolf, Sr. et al.

[11] 4,310,213

[45] Jan. 12, 1982

[54] ELECTRICAL CONNECTOR KIT

[75] Inventors: James R. Fetterolf, Sr., Burnsville, Minn.; Donald L. Metzger, Harrisburg, Pa.; Clair W. Snyder, Jr., Hellam, Pa.; James H. Wise, Harrisburg, Pa.

[73] Assignee: AMP Incorporated, Harrisburg, Pa.

[21] Appl. No.: 52,991

[22] Filed: Jun. 28, 1979

Related U.S. Application Data

[63] Continuation of Ser. No. 893,744, Apr. 5, 1978, abandoned.

[51] Int. Cl.[3] ..... H01R 13/58

[52] U.S. Cl. ..... 339/103 M

[58] Field of Search ..... 339/89, 90, 101, 103, 339/176 R, 176 M, 252 R

[56] References Cited

U.S. PATENT DOCUMENTS

| | | | |
|---|---|---|---|
| 3,032,741 | 5/1962 | Fitzgerald | 339/252 R |
| 3,149,893 | 9/1964 | Dupre | 339/176 MP |
| 3,178,673 | 4/1965 | Krehbiel | 339/252 R |
| 3,402,382 | 9/1968 | De Tar | 339/103 |
| 3,437,980 | 4/1969 | Smith | 339/103 R |
| 3,533,053 | 10/1970 | Sosinski | 339/198 P |
| 3,588,783 | 6/1971 | Newman | 339/59 |
| 3,611,273 | 10/1971 | Alibert | 339/89 M |
| 3,649,956 | 3/1972 | Vrobel | 339/89 M |
| 3,721,939 | 3/1973 | Paugh | 339/101 |
| 3,763,460 | 10/1973 | Hatschek | 339/89 M |
| 3,861,778 | 1/1975 | Capra | 339/103 R |
| 3,885,849 | 5/1975 | Bailey et al. | 339/31 R |
| 3,901,574 | 8/1975 | Paullus et al. | 339/90 R |
| 3,947,080 | 3/1976 | Ege | 339/258 S |
| 3,986,765 | 10/1976 | Shaffer et al. | 339/103 R |
| 4,106,834 | 8/1978 | Horowitz | 339/44 M |

FOREIGN PATENT DOCUMENTS

| | | | |
|---|---|---|---|
| 494723 | 7/1953 | Canada | 339/103 R |
| 2245032 | 3/1974 | Fed. Rep. of Germany | 339/176 M |
| 2514686 | 10/1975 | Fed. Rep. of Germany | 339/252 R |

*Primary Examiner*—Joseph H. McGlynn

*Attorney, Agent, or Firm*—Frederick W. Raring; Adrian J. LaRue

[57] ABSTRACT

A kit for an electrical connector is disclosed for use in connecting a first electrical device to a second electrical device; for example, connecting an audio microphone to a CB radio. The kit includes a cable guard member receiving therethrough a cable from the first device; first and second terminal members, with the first terminal members connected to conductors of the cable; and a connector housing having cavities extending therethrough to receive the second terminal members. The second terminal members are loaded into the cavities and the first terminal members subsequently inserted therein in mating engagement with the second terminal members. When the connector housing and cable guard member are connected together and the housing plugged into a socket mounted in the second electrical device, electical connection is established between the first and second devices. The kit further includes cable strain relief means and coupling means to secure the connector to a mating connector.

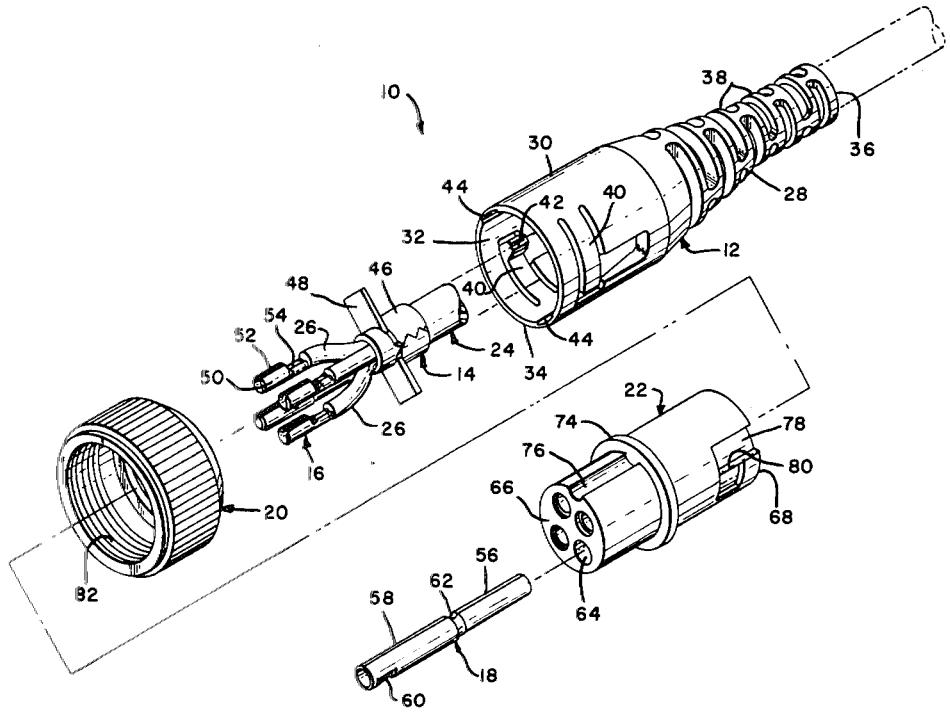

11 Claims, 11 Drawing Figures